US010458205B2

(12) United States Patent
Holtby et al.

(10) Patent No.: US 10,458,205 B2
(45) Date of Patent: Oct. 29, 2019

(54) REMOVABLE HAND GUARD FOR DRILLING RIG HAND TONGS

(75) Inventors: Quinn A. J. Holtby, Edmonton (CA); Dallas Laird Greenwood, Edmonton (CA)

(73) Assignee: KATCH KAN HOLDINGS LTD., Edmonton (CA)

( * ) Notice: Subject to any disclaimer, the term of this patent is extended or adjusted under 35 U.S.C. 154(b) by 1552 days.

(21) Appl. No.: 14/343,011

(22) PCT Filed: Apr. 4, 2011

(86) PCT No.: PCT/CA2011/000362

§ 371 (c)(1),
(2), (4) Date: Mar. 5, 2014

(87) PCT Pub. No.: WO2011/123934

PCT Pub. Date: Oct. 13, 2011

(65) Prior Publication Data

US 2014/0224082 A1 Aug. 14, 2014

Related U.S. Application Data

(60) Provisional application No. 61/321,001, filed on Apr. 5, 2010.

(51) Int. Cl.
*E21B 19/16* (2006.01)
*E21B 41/00* (2006.01)

(52) U.S. Cl.
CPC ..... *E21B 41/0021* (2013.01); *E21B 19/16* (2013.01); *E21B 19/161* (2013.01); *Y10T 29/49826* (2015.01); *Y10T 29/49998* (2015.01)

(58) Field of Classification Search
CPC ..... E21B 41/0021; E21B 19/16; E21B 19/161
USPC ..... 81/57–57.37; 16/110.1–114.1, 405–446
See application file for complete search history.

(56) References Cited

U.S. PATENT DOCUMENTS 4,572,545 A 2/1986 Dooley, Jr.
6,119,558 A 9/2000 Foley, Jr.
6,327,940 B1 * 12/2001 Price ..... E21B 19/161 81/177.1
6,640,668 B2 * 11/2003 George ..... E21B 19/16 81/177.6

FOREIGN PATENT DOCUMENTS

CA 2353510 A1 1/2003
CN 201990366 U * 9/2011

OTHER PUBLICATIONS

International Search Report dated Jul. 15, 2011, issued in corresponding International Application No. PCT/CA2011/000362, filed Apr. 4, 2011, 3 pages.

* cited by examiner

*Primary Examiner* — Bryan R Muller
(74) *Attorney, Agent, or Firm* — Christensen O'Connor Johnson Kindness, PLLC

(57) ABSTRACT

A removable hand guard is provided for installation on drilling rig hand tongs and used to protect the hands of workers from being accidentally crushed when gripping the tong handle. The hand guard can include resilient body and tabs, which allow the guard to be positioned on the tong handle. The hand guard can be locked into place using locks and fasteners. The hand guard can include a slot, which can form a secondary handle to be used by a second worker to maneuver the tongs.

6 Claims, 5 Drawing Sheets

Figure 1 - Prior Art

REMOVABLE HAND GUARD FOR DRILLING RIG HAND TONGS

CROSS-REFERENCE TO RELATED APPLICATIONS

This application claims priority of U.S. provisional patent application Ser. No. 61/321,001 filed Apr. 5, 2010, and hereby incorporates the same provisional applications by reference herein in their entirety.

TECHNICAL FIELD

The present disclosure is related to the field of drilling rig hand tongs, in particular, a removable hand guard for drilling rig hand tongs.

BACKGROUND

Hand tongs are used on a drilling rig for gripping drill pipe or other tubulars. Drilling personnel manoeuvre the hand tongs by gripping and pulling handles on the tong which allow the tong to open and close. Accidents occur in which workers gripping the tong handles have sustained crushed hands or fingers. Referring to FIG. 1, a drilling rig hand tong 10 known in the prior art is shown, in this prior art device, tong 10 includes handle 12 that can be gripped by a worker's hand (not shown), and jaw 14 to grip drill pipe and other tubulars (not shown). Handle 12 includes a protruding rounded top boundary 16 and a protruding rounded bottom boundary 18.

It is known in the art to attach a hand guard to the tong to protect the hands of the workers. However, these existing prior art hand guards will only fit on particular types of hand tong handles, and are difficult to install and remove.

For the safety of the personnel working on the drilling rig, it is desirable to provide a hand protection method and a hand guard suitable for retrofitting onto existing hand tongs, where the installation of the hand guard is simplified.

SUMMARY

A removable hand guard is provided for installation on drilling rig hand tongs and used to protect the hands of workers from being accidentally crushed when gripping the tong handle. The hand guard can include resilient body and tabs, which allow the guard to be positioned on the tong handle. The hand guard can be locked into place using locks and fasteners. The hand guard can include a slot, which can form a secondary handle to be used by a second worker to manoeuvre the tongs.

Broadly stated, in some embodiments, a hand guard is provided for attaching to a drilling rig hand tong handle, the hand guard comprising: a body capable of attaching to the tong handle, the tong handle comprising a top boundary and a bottom boundary; a top tab and a bottom tab each extending from the body, which can be positioned behind the top and bottom handle boundaries while the body remains in front of the handle boundaries; and means for securing the body to the tong handle thereby guarding the tong handle.

Broadly stated, in some embodiments, a method is provided for protecting the hands of drilling rig personnel operating a drilling rig hand tong handle, the method comprising the steps of: providing a hand guard for the tong handle, the hand guard comprising: a body capable of attaching to the tong handle, the tong handle comprising a top boundary and a bottom boundary, a top tab and a bottom tab each extending from the body, which can be positioned behind the top and bottom handle boundaries while the body remains in front of the handle boundaries, and means for securing the body to the tong handle thereby guarding the tong handle; and installing the hand guard on the tong handle.

Broadly stated, in some embodiments, a method is provided for gripping tubulars on a drilling rig, the method comprising the steps of: providing one or more hand tongs, the tongs comprising; a jaw having an open and a closed position, at least one tong handle attached to the jaw used for moving the jaw between the open and closed positions, one or more hand guards attached to the tong handles, each hand guard comprising: a body configured to attach to the tong handle, the tong handle comprising a top boundary and a bottom boundary, a top and bottom tab each extending from the body, which can be positioned behind the top and bottom handle boundaries while the body remains in front of the handle boundaries, and means for securing the body to the tong handle thereby guarding the tong handle, positioning the hand tong jaws in the open position; encompassing a tubular with the hand tongs; and positioning the hand tong jaws in the closed position to grip the tubular.

Figure 1:
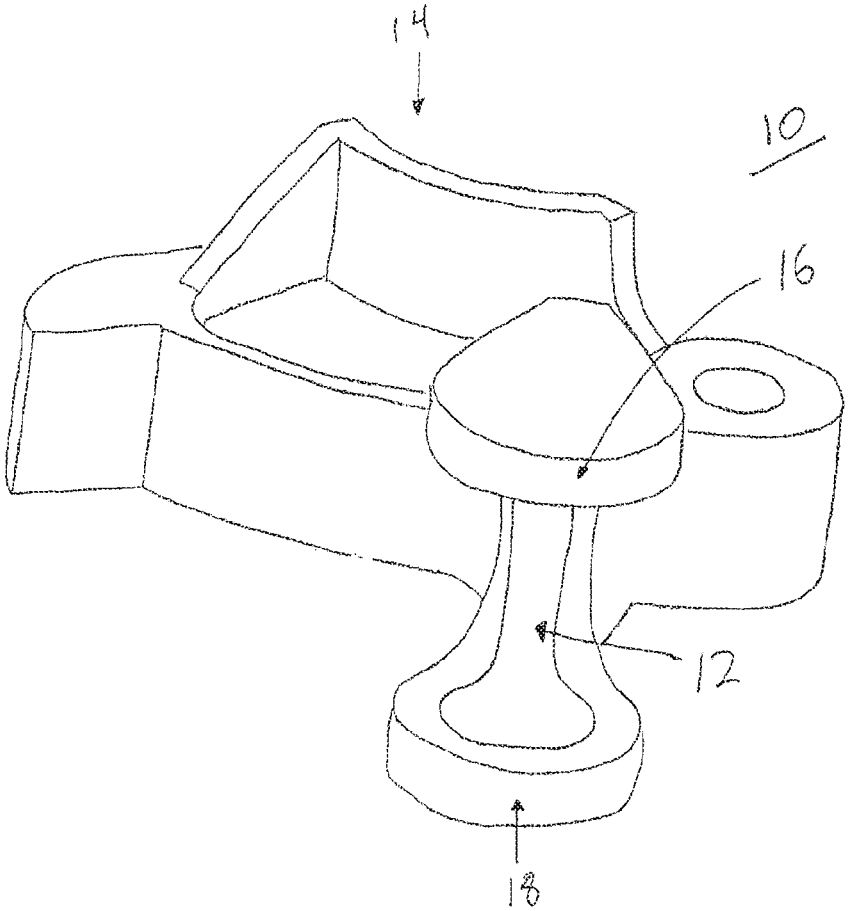
FIG. 1 is a side perspective view depicting the prior art tong jaw and handle.

DETAILED DESCRIPTION OF EMBODIMENTS:

Referring to FIGS. 2, 3, 4 and 5, a representative embodiment of a removable hand guard for drilling rig hand tongs is illustrated, generally identified by reference numeral 20.

Figure 2:
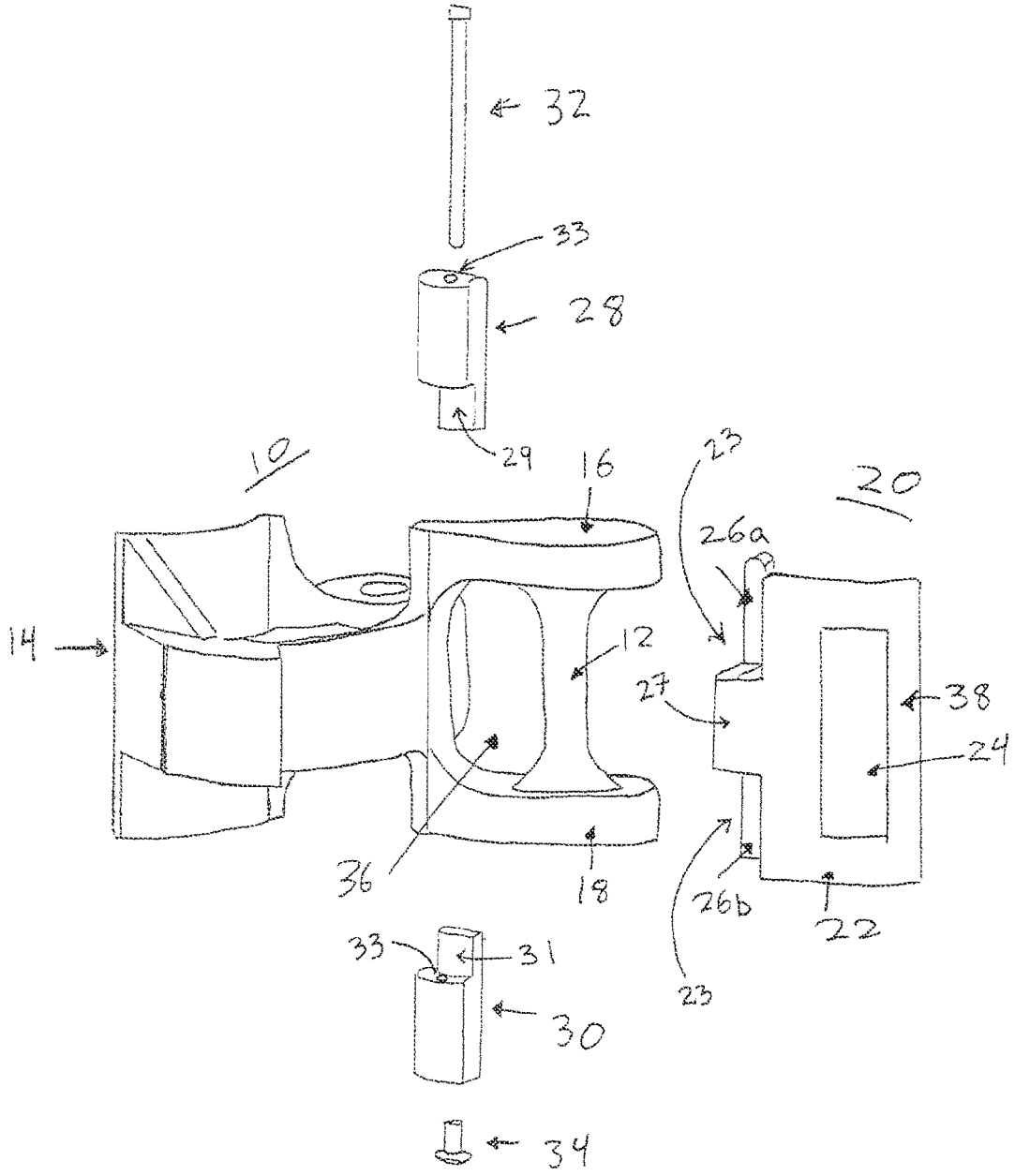
FIG. 2 is an exploded front perspective view of the tong jaw illustrated in FIG. 1, the hand guard and the guard lock.

Referring to FIG. 2, hand guard 20 can include body 22 with slot 24. In some embodiments, top and bottom tabs 26*a* and 26*b* can be disposed at the base of body 22, and can further allow hand guard 20 to be installed in front of handle 12 with tabs 26*a* and 26*b* positioned behind handle boundaries 16 and 18, thereby guarding handle 12 of tong 10. In some embodiments, L-shaped member 27 can be disposed between tabs 26*a* and 26*b*, and body 22 thereby defining notches 23 on body 22, Hand guard 20 can be locked in place by top lock 28 and bottom lock 30 connected by bolt 32 and connecting nut 34 passing through apertures 33 disposed through locks 28 and 30, or any other functionally equivalent types of fasteners such as a ready rod and quick pin, or a lag bolt, or any other fastener as known by those skilled in the art. In some embodiments, top lock 28 can further comprise tab 29, and bottom lock 30 can further comprise tab 31.

Figure 3:
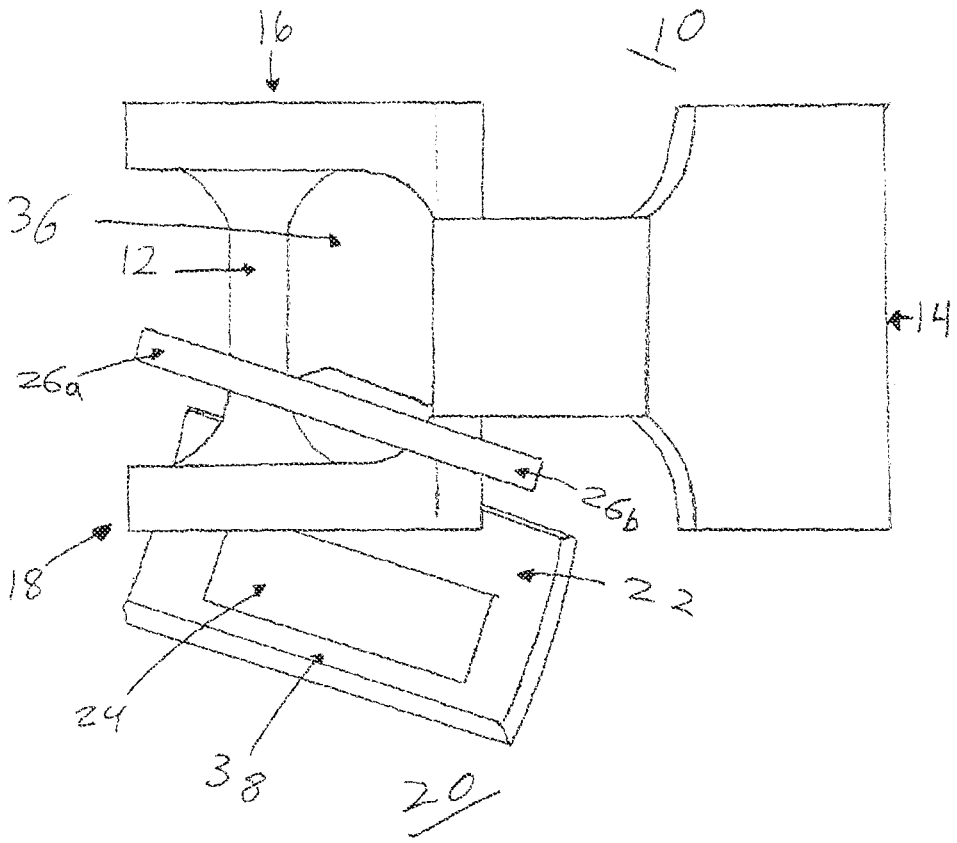
FIG. 3 is a rear elevation view depicting the hand guard in the process of being inserted into the tong jaw handle.

Referring to FIG. 3, hand guard 20 is shown in a partially installed state on tong 10. Tabs 26 of hand guard 20 can be positioned through opening 36 between handle 12 and tong 10. Body 22 and tabs 26 of hand guard 20 can be made of a resilient material, so that tabs 26 are resilient enough to remain in place behind handle boundaries 16 and 18 and body 22 is resilient enough to protect the hands of drilling rig personnel from being crushed. Body 22 and tabs 26 of hand guard 20 can be made of metal, fiber composite, plastic, urethane, or other functionally equivalent resilient materials as known by those skilled in the art.

Figure 4:
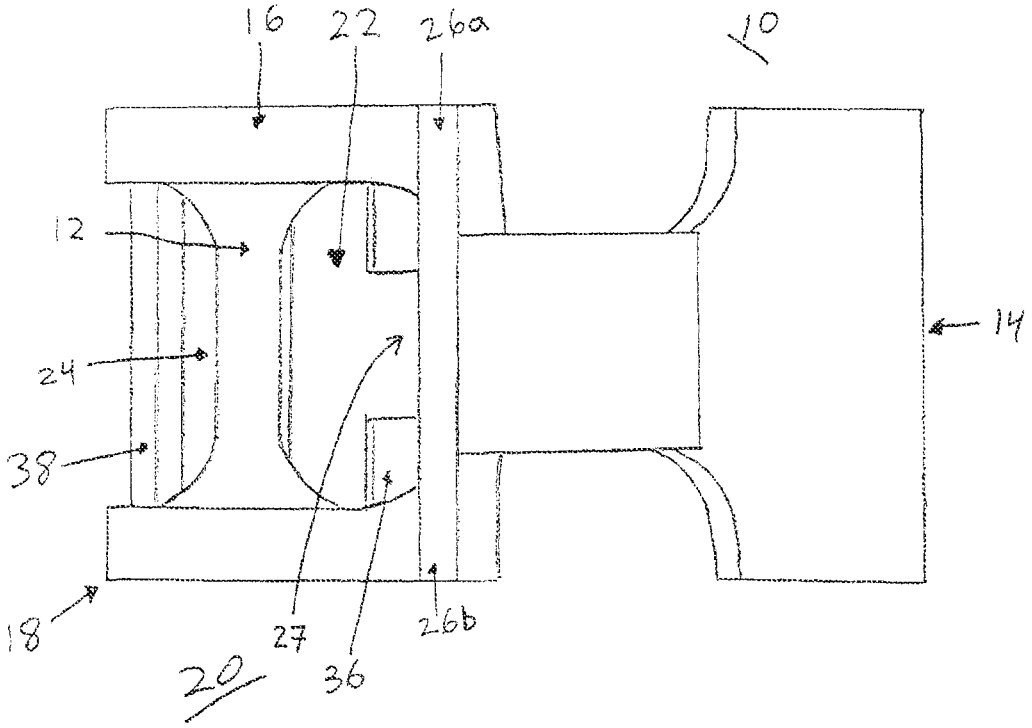
FIG. 4 is a rear elevation view depicting the hand guard inserted in place on the tong jaw handle.

Referring now to FIG. 4, hand guard 20 can be turned into place with tabs 26 and body 22 on opposite sides of handle boundaries 16 and 18.

Figure 5:
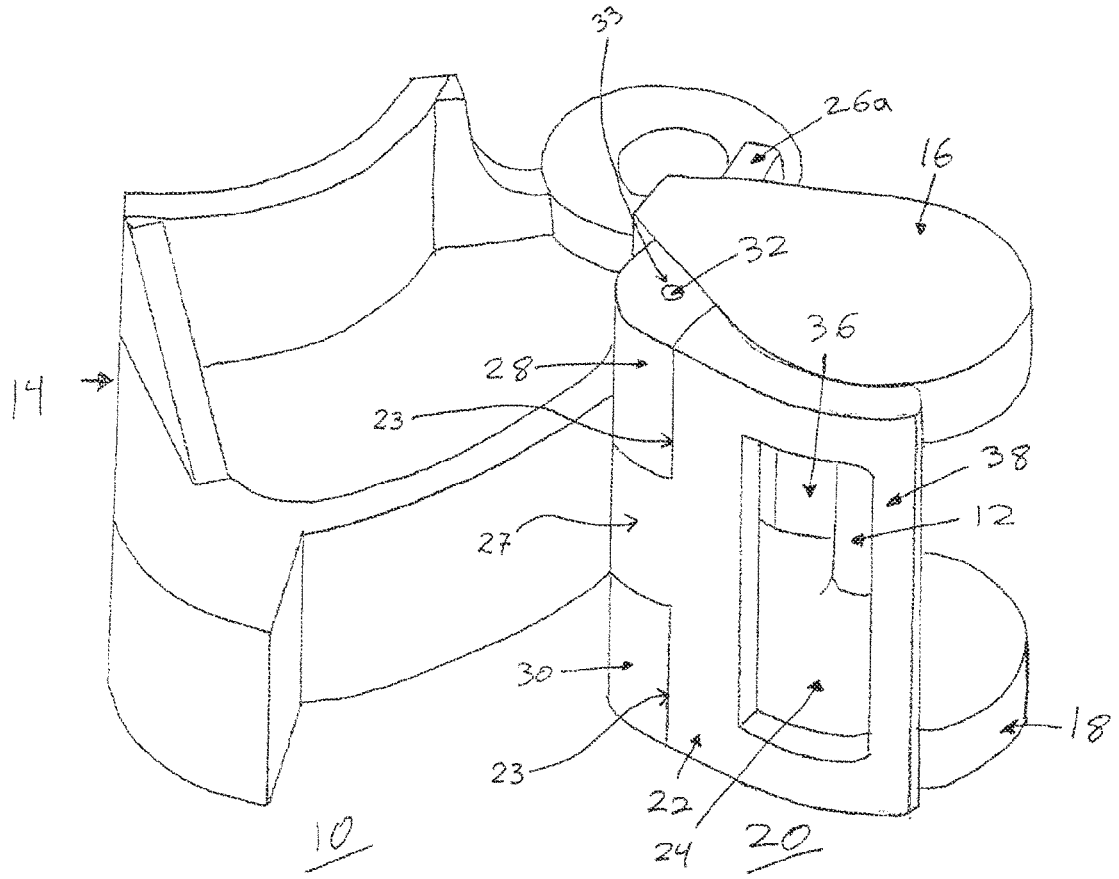
FIG. 5 is an assembled front perspective view of the hand guard locked on the tong jaw handle.

Referring now to FIG. 5, hand guard 20 can be locked into position on tong 10 with locks 28 and 30 placed in notches 23 of body 22 wherein tabs 29 and 31 can fit behind L-shaped member 27. Bolt 32 can then placed through apertures 33 to threadably attach to nut 34. In other embodiments, aperture 33 disposed in bottom lock 30 can be threaded to threadably receive bolt 32 thereby eliminating the need for nut 34.

When in use, hand guard 20 can protect a worker's hand (not shown) when operating tong 10 by gripping handle 12. In one embodiment, slot 24 in hand guard 20 can form secondary handle 38, which can be gripped by a second worker in order to assist in pulling the tong jaw 14 into a closed position.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A hand guard for attaching to a drilling rig hand tong handle, the tong handle comprising top and bottom supports each having front and rear portions and a tong grip therebetween, the hand guard comprising:

a) a body capable of attaching to the tong handle, the body having a connecting portion configured to connect to the tong handle and a protecting portion configured to provide a barrier to guard against objects impacting the tong grip;

b) the body comprising an L-shaped portion connected at one end to the protecting portion and having top and bottom tabs extending from the L-shaped portion and spaced from the protecting portion, the L-shaped portion capable of being inserted between the top support and the bottom support to position the protecting portion on the front side of the top and bottom supports and the top and bottom tabs on the rear side of the top and bottom support;

c) the top tab extending from the L-shaped portion of the body in a first direction towards the top support and the bottom tab extending from the L-shaped portion of the body in a second direction towards the bottom support; and d) means for securing the body to the tong handle, thereby guarding the tong handle.

2. The hand guard as set forth in claim 1, wherein the securing means further comprises top and bottom locks configured to sandwich a portion of the L-shaped member therebetween, each lock comprising an aperture passing therethrough, and a fastener configured to pass through the apertures and secure the locks to the hand guard.

3. The hand guard as set forth in claim 1, wherein the body is comprised of a resilient material.

4. The hand guard as set forth in the claim 3, wherein the resilient material comprises one or more of the group consisting of metal, fiber composite, plastic and urethane.

5. The hand guard as set forth in claim 2, wherein the body is comprised of a resilient material.

6. The hand guard as set forth in claim 5, wherein the resilient material comprises one or more of the group consisting of metal, fiber composite, plastic and urethane.

* * * * *